US007997286B2

(12) United States Patent
Eng et al.

(10) Patent No.: US 7,997,286 B2
(45) Date of Patent: Aug. 16, 2011

(54) COSMETIC COMPACT

(75) Inventors: Serena Eng, Warren, NJ (US); Charles Chang, Wayne, NJ (US)

(73) Assignee: Charles Chang, Wayne, NJ (US)

( * ) Notice: Subject to any disclaimer, the term of this patent is extended or adjusted under 35 U.S.C. 154(b) by 942 days.

(21) Appl. No.: 11/893,817

(22) Filed: Aug. 17, 2007

(65) Prior Publication Data

US 2009/0044826 A1 Feb. 19, 2009

(51) Int. Cl.
*A45D 33/22* (2006.01)

(52) U.S. Cl. ..... 132/295

(58) Field of Classification Search ..... 132/293–296, 132/298, 300, 301; 220/811–813; 206/581, 206/823

See application file for complete search history.

(56) References Cited

U.S. PATENT DOCUMENTS

| | | | | |
|---|---|---|---|---|
| 1,689,359 | A | 10/1928 | Miller | |
| 1,908,132 | A | 5/1933 | Duell | |
| 2,104,104 | A | 1/1938 | Schisgall | |
| 2,180,404 | A * | 11/1939 | Eastley | 132/316 |
| 2,796,070 | A | 6/1957 | Marsak | |
| 3,586,010 | A | 6/1971 | Landen | |
| 4,546,782 | A * | 10/1985 | Kucher | 132/328 |
| D293,837 | S | 1/1988 | Simonetti | |
| 4,726,387 | A | 2/1988 | Sarica | |
| 6,073,634 | A | 6/2000 | Gueret | |
| 7,163,016 | B2 | 1/2007 | Kingsford et al. | |
| 2003/0154996 | A1 * | 8/2003 | Bourjal | 132/293 |
| 2006/0169298 | A1 | 8/2006 | Thiebaut | |
| 2006/0219256 | A1 | 10/2006 | Byun | |

* cited by examiner

*Primary Examiner* — Rachel R Steitz
(74) *Attorney, Agent, or Firm* — K. Gibner Lehmann

(57) ABSTRACT

A cosmetic compact providing a molded plastic base, a first cover and combined second cover and grip handle, all disposed over the base. The first cover is hinged to the base. The combined second cover and grip handle are selectively removable from the base, and carry an applicator device which when stored, is disposed between the first cover and base. The arrangement enables the user to quickly open the first cover and immediately remove and manipulate the combined second cover and grip handle, and attached applicator device, for application of cosmetic to the face or body. An especially neat, compact construction thereby is realized.

4 Claims, 15 Drawing Sheets

COSMETIC COMPACT

STATEMENT AS TO RIGHTS TO INVENTIONS MADE UNDER FEDERALLY SPONSORED RESEARCH AND DEVELOPMENT

Research and development of the present invention and application have not been Federally-sponsored, and no rights are given under any Federal program.

BACKGROUND OF THE INVENTION

1. Field of the Invention

This invention relates generally to cosmetic compacts, and more particularly to small, molded plastic units which can be readily carried in a pocketbook or purse.

2. Description of the Related Art Including Information Disclosed Under 37 CFR 1.97-1.99

The following references are hereinbelow listed as being considered a representative sampling of prior art in the field to which the present invention pertains:

U.S. Pat. Nos.: 1,689,359 1,908,132 2,104,104 2,796,070 3,586,010 4,726,387 6,073,634 7,163,016

U.S. Design Pat. No. Des. 293,837

U.S. patent applications Publications Nos.: 2006/0169298 2006/0219256

U.S. Pat. No. 6,073,634 discloses several forms of mascara applicators. FIG. 7 of the patent shows one construction employing a cosmetic-carrying base, a hingedly connected lid and attached mirror on the base, and an applicator handle carrying at one end, a series of brushes or bristles. The arrangement is such that the handle and bristles can be housed in one compartment of the base, and the cosmetic substance per se, carried in a separate compartment in the base. The hinged lid and mirror can be folded down over the separate compartment and thus cover the bristles of the handle. The latter projects from the end of the base, in the manner of FIG. 5A of the patent.

U.S. Pat. No. 4,726,387 illustrates a somewhat similar arrangement, showing a compact with a one-piece base and cover. The base of the compact has a compartment for product, and a handle that carries a brush, the latter in turn fitting into another compartment of the base, and wherein the handle closes off the end of the base when the compact is closed.

U.S. Pat. Nos. 2,104,104 and 3,586,010 both relate to drawer-type compacts, each having an interior compartment for product, and mirror members that are automatically arranged to pop open when the cover of the compact is slid to one side by a pre-determined extent. U.S. Pat. No. '104 utilizes dual compartments for the cosmetic substance or substances being supplied.

U.S. Pat. No. 1,908,132 discloses a cosmetic compact utilizing a base member having a hinged cover and mirror combination, and a slidable cover. As noted on page 2, lines 26 on, part of the hinged cover fits beneath part of the slidable cover in order that the slidable cover can be retained by the hinged cover when the compact is closed, as in storage.

U.S. Pat. No. 1,689,359 relates to a cosmetic compact which provides dual compartments, presumably to accommodate different cosmetic substances, and a drawer-type mechanism which provides access to one compartment and at the same time enables a mirror component to be placed in an open position from which it can be viewed in the usual manner.

Patent Application Publication No. 2006/0169298 relates to several arrangements of make-up kits. Multiple product storage compartments are provided in an elongate base, and the kits have an elongate applicator stick containing a tip or applicator element. The latter is receivable in an elongate opening of the base when the applicator stick is placed on top of the base. In the FIG. 4 arrangement, the tip overlies a compartment (133) containing one of the products being used.

U.S. Pat. No. 7,163,016 shows a number of cosmetic dispenser forms having somewhat diverse specific characteristics. In the form illustrated in FIGS. 1-5 there is provided an elongate casing having a pair of inner compartments, one being for holding a quantity of product, and a second being adapted for receiving the applicator end of an applicator stick. The compartments are sealingly separated from one another, to circumvent inadvertent dry-out of either the product or the applicator tip.

U. S. Patent Application Publication No. 2006/0219256 illustrates still another drawer-type compact with a base having multiple cup-like compartments for storage of product, and having a hinged lid which closes over the compartments during storage. A pop-up tray carried in the base is provided with multiple slots of differing widths, to respectively accommodate different sized applicator brushes, in the manner of FIG. 3 of the application.

U.S. Pat. No. 2,796,070 describes a vanity kit utilizing a housing or carrier member, and an applicator/holder provided with bristles and adapted for use as a brush, and further having an opening in its end, for holding a lipstick. The back of the applicator/holder is grooved, and arranged to hold captive a self-contained cosmetic compact housing or casing, in toto.

Finally, U. S. Design Pat. No. D 293,837 illustrates a substantially rectangular cosmetic compact of the pull-out drawer type, and having an inner mirror that comes into view when the compact is opened by the user.

It is considered that large scale commercialization of the devices noted above has not occurred. Undue complexity may have been a concern. Alternately, promotional considerations may have prevented the disclosed arrangements from being made and sold in quantity.

It is further noted that some of the devices discussed above did not relate directly to cosmetic applications. Accordingly, the relatively high demand today, for treatments to the face, hands, and body, has resulted in the need for large-scale, inexpensive yet reliable methods and fixtures for storing and dispensing health-care and/or beauty-care products.

SUMMARY OF THE INVENTION

The above shortcomings of prior cosmetic and like dispensers are largely overcome by the present invention, which has for an object the provision of a novel and improved cosmetic compact which is especially simple in its structure, and which provides especially rapid access to cosmetic material contained therein.

A related object of the invention is to provide an improved cosmetic compact as above characterized, that can be readily stored in a pocketbook or purse, and thereafter readied for use by the consumer, with a minimum of effort.

A further object of the invention is to provide an improved cosmetic compact of the type noted above, wherein there are virtually eliminated problems with spillage of product, thus making use of the compact especially neat and tidy.

Still another object of the invention is to provide an improved cosmetic compact of the kind indicated, which can be readily molded in simple mold cavities, and assembled with a minimum of time and with no special equipment being required.

The objects are accomplished, in a main embodiment, by a cosmetic compact comprising a unique combination of a molded plastic base, a first cover, and a combined second cover and grip handle, all disposed over the base. The base has an upwardly facing compartment for storing a quantity of cosmetic product. The base further has a hinged end and a free end disposed opposite to the hinged end. There are hinge means connecting the first cover to the hinged end of the base, to enable the first cover to be manually swung between a closed position overlying the hinged end of the base and an open position exposing the hinged end of the base. There are further provided cooperable means on the combined second cover and grip handle and also on the base, for releasably securing the combined second cover and grip handle to the base. This combined second cover and grip handle, when secured to the base, overlies the compartment and forms an abutting-type fit therewith so as to minimize inadvertent drying out of the cosmetic product stored therein. Also provided is an applicator device carried by the combined second cover and grip handle. The combined second cover and grip handle position the applicator device at a location which is disposed between the first cover and the hinged end of the base at such times as the first cover is in its closed position, and the combined second cover and grip handle is secured to the base.

This arrangement enables the user to quickly open the first cover and immediately remove and manipulate the combined second cover and grip handle and attached applicator device, for application of cosmetic to the face or body.

Other features and advantages will hereinafter appear.

BRIEF DESCRIPTION OF THE DRAWINGS

In the drawings, illustrating several embodiments of the invention.

DESCRIPTION OF THE PREFERRED EMBODIMENTS

Figure 1:
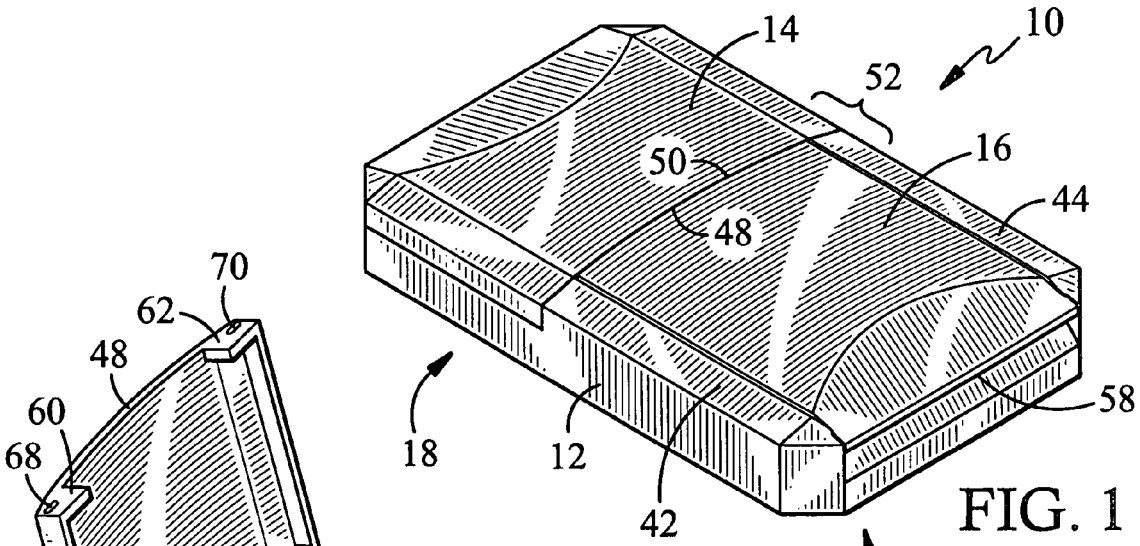
FIG. 1 is a perspective view of the improved compact of the invention, illustrating the compact's base and its two covers in their closed positions respectively.

Referring first to FIGS. 1-11 and in accordance with the present invention there is illustrated a novel and improved cosmetic compact designated generally by the numeral 10. The compact 10 is constituted of molded plastic, and includes an elongate base 12, a cover 14 and a combined second cover and grip handle 16. One end 18 of the base is hereinafter referred to as a hinged end or proximal end, and the other end 20 is termed a free end or distal end of the base 12.

Figure 4:
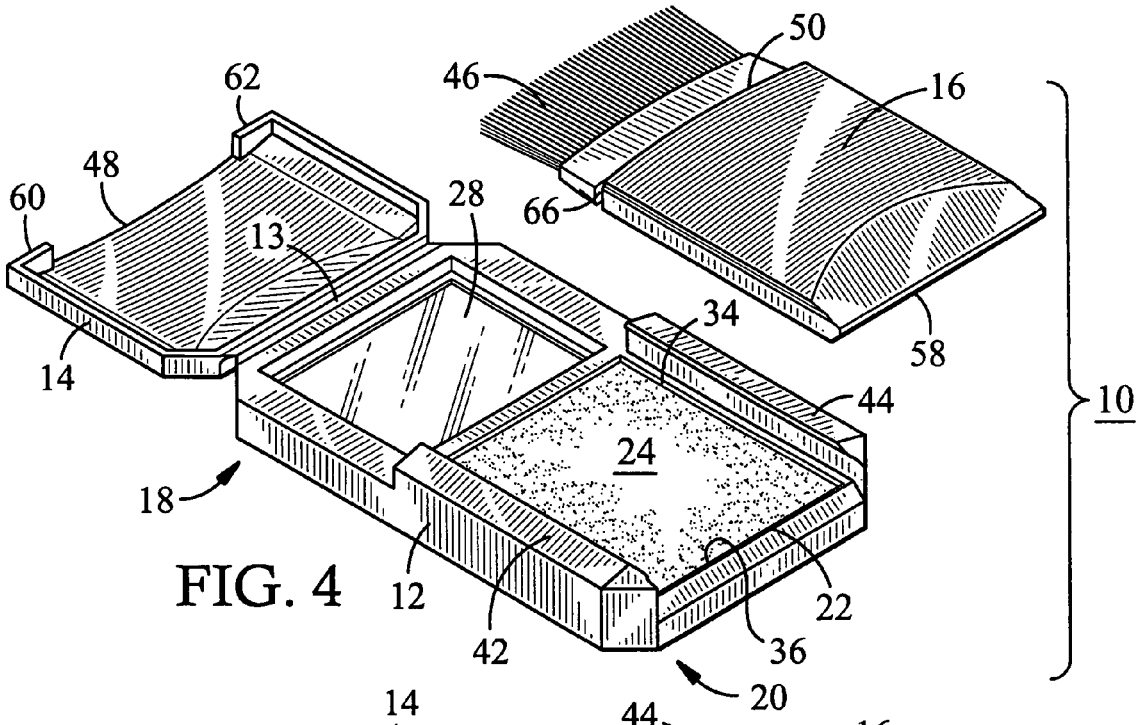
FIG. 4 is a perspective view of the compact of FIGS. 1-3, with the cover at the hinged end of the base fully open, and showing a mirror in a compartment that lies directly beneath the cover when the latter is closed.

As can be readily seen in FIG. 4, the base 12 has one upwardly facing compartment 22 at its free end 20, and this compartment contains a quantity of cosmetic substance or material 24 to be stored and used. A second compartment 26 is disposed adjacent the hinged end 18 of the base 12, for use in storing either additional cosmetic material, or in some other embodiments, to provide a nest for an upwardly facing mirror 28.

Figure 7:
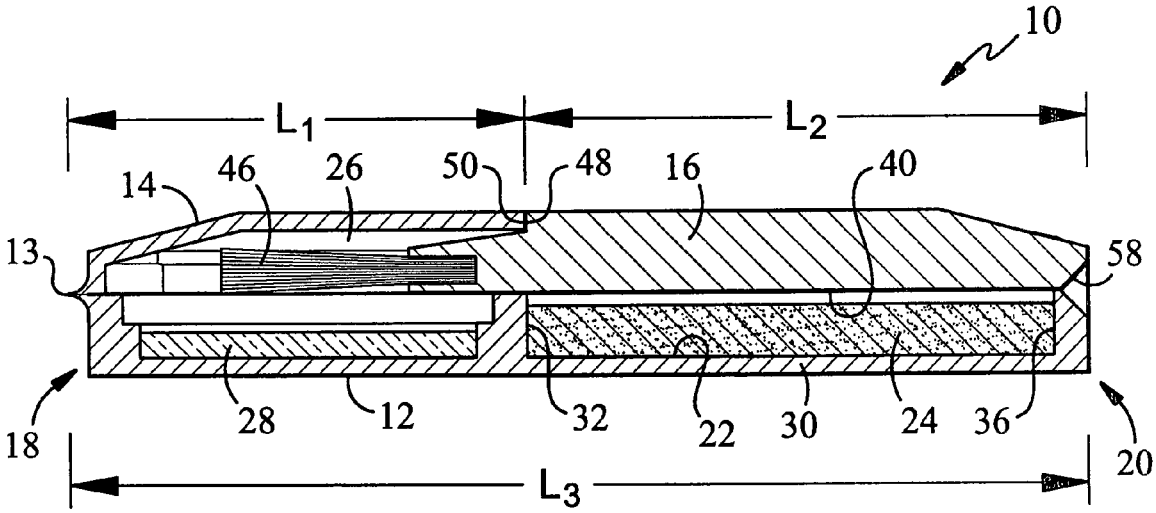
FIG. 7 is a section taken on the line 7-7 of FIG. 5.
Figure 8:
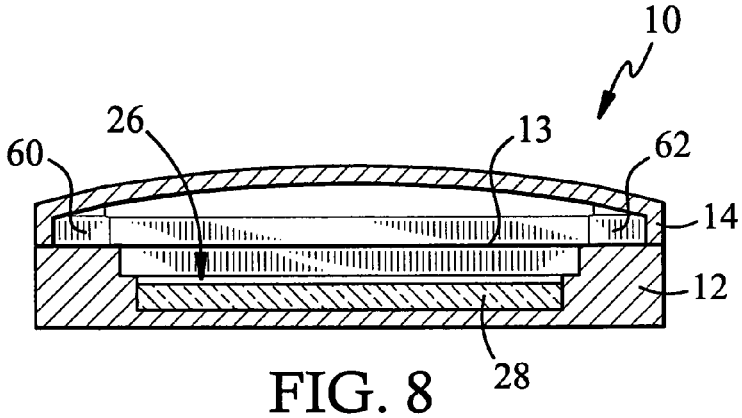
FIG. 8 is a section taken on the line 8-8 of FIG. 6.

The compartment 22 has a bottom wall 30, FIG. 7, that is common with the base 12, and four side walls 32, 34, 36 and 38, respectively connected therewith, each side wall having an upper portion or lip which is adapted for abutting and sealing engagement with the bottom surface 40 of the combined second cover and grip handle 16 noted above.

Figure 2:
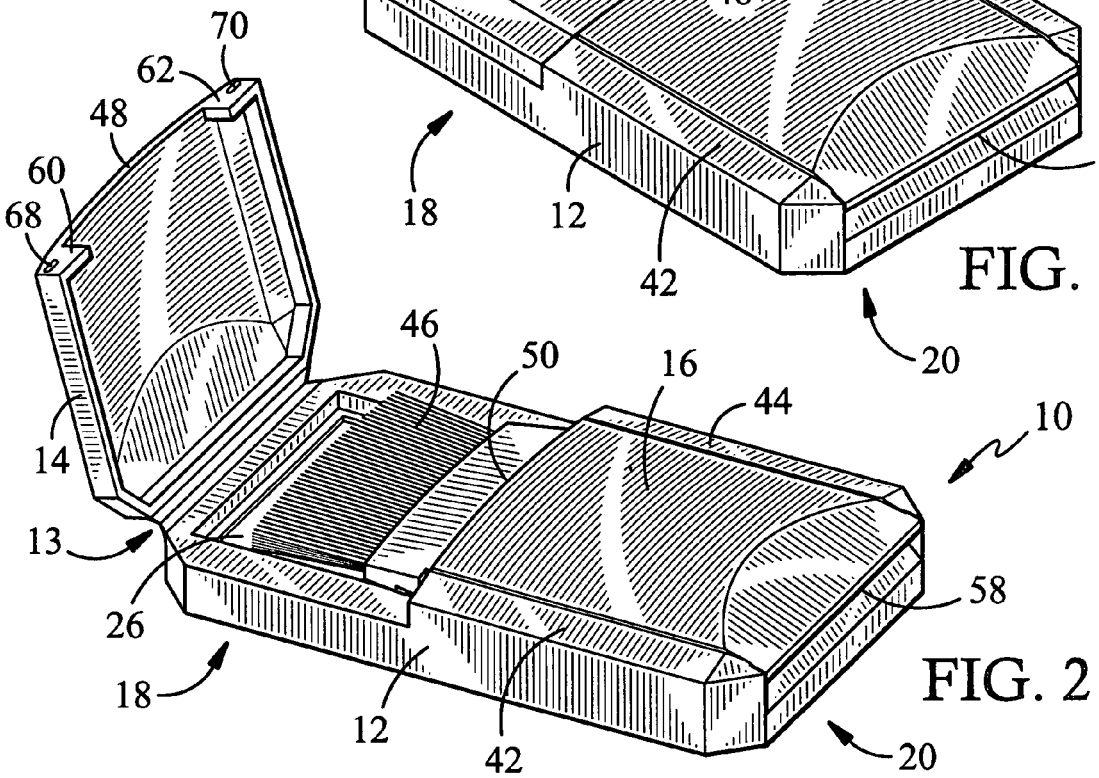
FIG. 2 is a view like FIG. 1, except with the cover that is disposed at the hinged end of the base being open. The cover is secured to the base by a living hinge.
Figure 3:
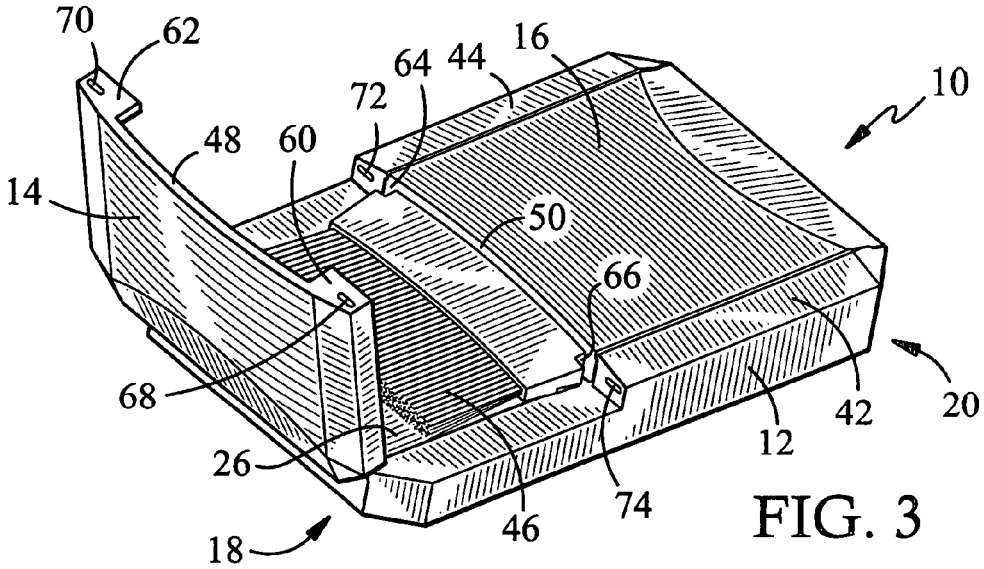
FIG. 3 is a view like FIG. 2, except showing the compact as it appears when viewed from another position.
Figure 5:
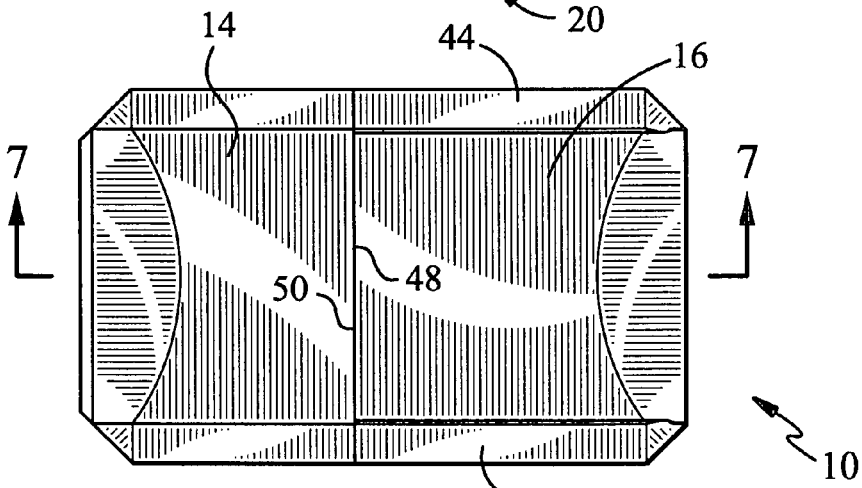
FIG. 5 is a top plan view of the compact of FIGS. 1-4, with both covers disposed in their closed positions respectively.
Figure 6:
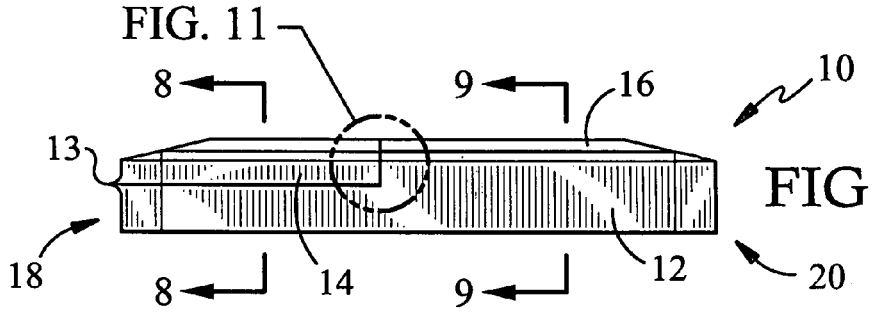
FIG. 6 is a front elevation of the compact of FIGS. 1-5.

By the invention, the cover 14 is hingedly secured to the hinged end 18 of the compact 10, and can be swung between a closed position overlying part of the compact base 12, as shown in FIGS. 1, 5 and 6, and an open position illustrated in FIGS. 2-4, exposing the base 12.

Figure 9:
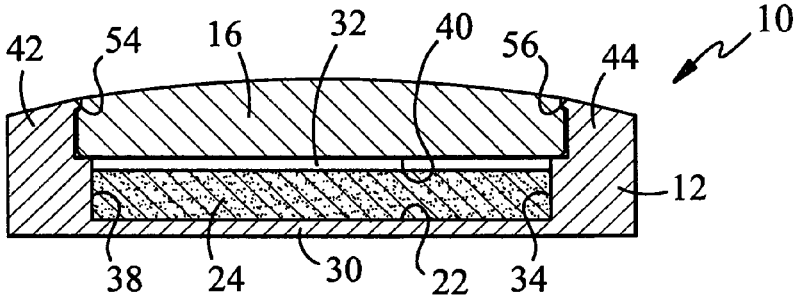
FIG. 9 is a section taken on the line 9-9 of FIG. 6.

The combined second cover and grip handle 16 is removable, and is retained in position over the cosmetic-containing compartment 22 by means of oppositely disposed, resilient plastic, upstanding flanges 42, 44 on the base, FIGS. 1-4 and 9. As noted above, the combined second cover and grip handle's bottom wall surface 40 is flat as shown in FIGS. 7 and 9, which makes abutting contact with the upper part of the compartment walls 32, 34, 36 and 38 in these figures, to minimize any tendency for the cosmetic substance or material 24 to evaporate or otherwise dry out.

By the invention, the combined second cover and grip handle 16 carries an applicator device, in the present form of the invention, being in the manner of a brush 46. The brush or an equivalent, is later on referred to as a product-holding distributing portion or part. The arrangement is such that with the combined second cover and grip handle 16 occupying a closed position shown in FIGS. 1-3, 5 and 6, the applicator device or brush 46 is disposed in the compartment or space 26 between the hinged end 18 of the base 12 and the first cover 14.

In a preferred construction, the cover 14 and combined second cover and grip handle 16 are sized to just overlie the base 12. The length of the cover 14 is indicated in FIG. 7 by the designation L1. The length of the combined second cover and grip handle 16 is indicated L2. The invention provides that the sum of L1 and L2 is just equal to the overall length L3 of the base 12, as shown. In addition and in reference to FIGS. 1, 5 and 6, the cover 12 and combined second cover and grip handle 16, when in their closed positions, have abutting edge portions 48, 50, which provide for an essentially continuous upper surface to the compact. Stated differently, the upper surfaces of the cover 14 and combined second cover and grip handle 16 essentially constitute continuations of one another, to provide an especially attractive, flush surface configuration 52, FIG. 1, to the uppermost parts of the compact. As a result, the arrangement provides a physically small, neat package that can be readily carried in a purse or pocketbook.

Referring again to FIGS. 4 and 9, the combined second cover and grip handle 16 is releasably held between the flanges 42, 44 respectively, by suitable retainer means, shown as being in the form of a pair of oppositely disposed, resilient longitudinal ribs 54, 56 on the flanges 42, 44 respectively. The flanges 42, 44 and ribs 54, 56 are all sufficiently resilient that the removable combined second cover and grip handle 16 can be pried upwardly and by-pass the ribs, for opening the compact. The opening procedure is assisted by a lifting surface 58, FIGS. 1, 2, 4 and 7, on the end of the combined second cover and grip handle 16, which provides a space for the user to insert her fingernail and pry the combined second cover and grip handle 16 upwardly.

Figure 10:
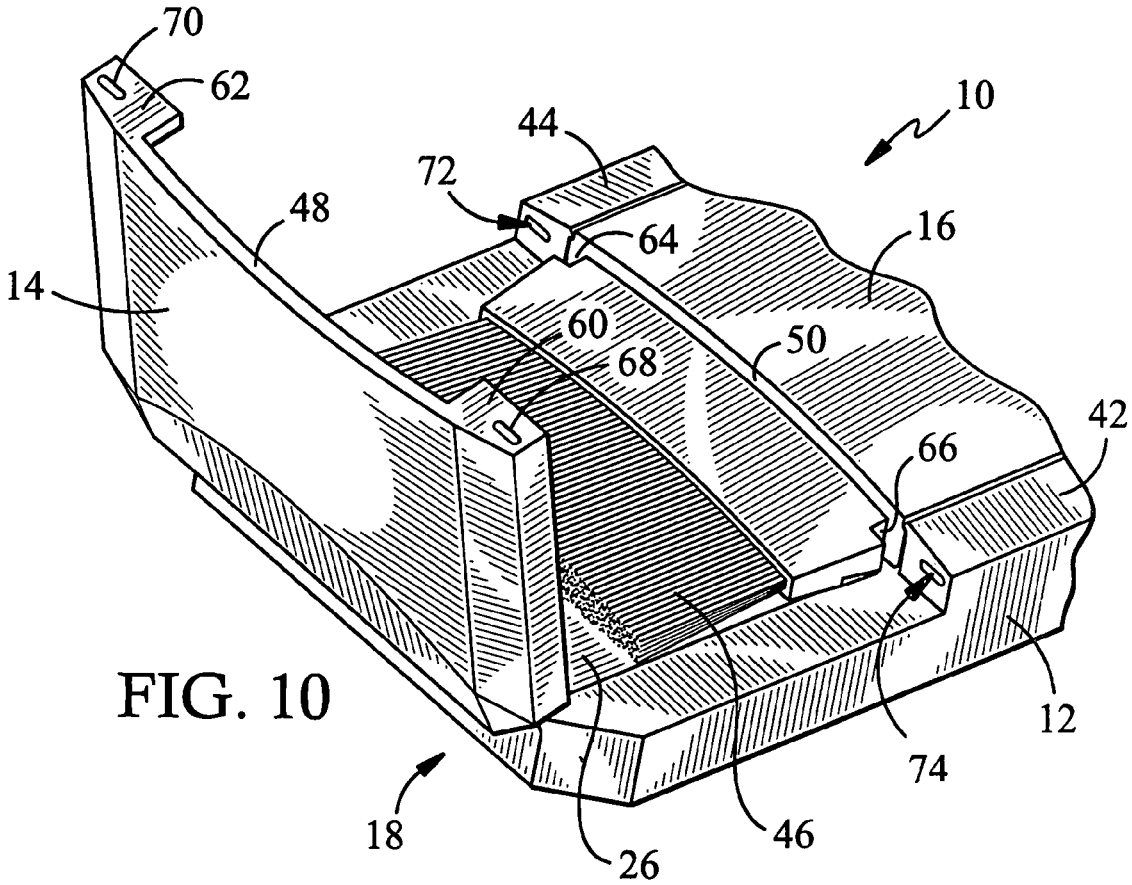
FIG. 10 is a fragmentary perspective view of the compact of FIGS. 1-9, with the cover at the hinged end of the base being disposed in an open position, and showing retainer structures which cooperate with this cover and with a second cover.
Figure 11:
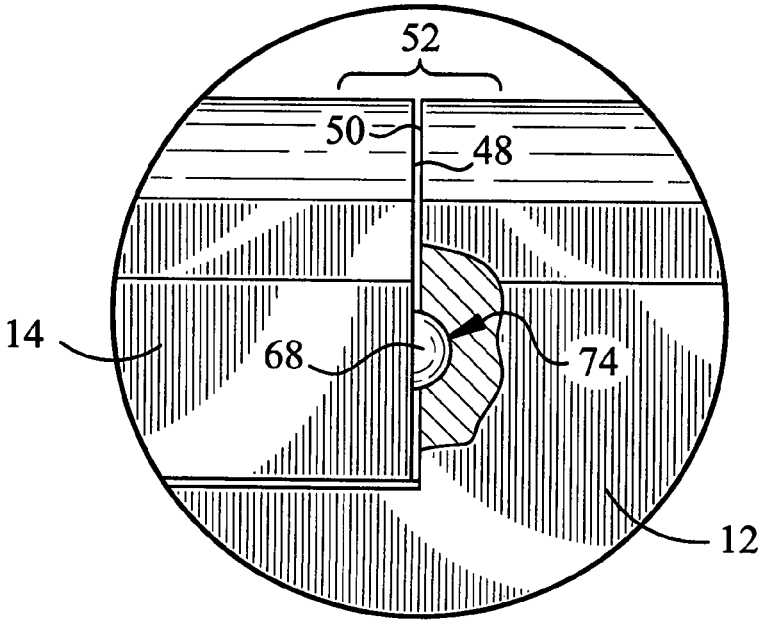
FIG. 11 is a detail of the abutting ends of the covers, at the location shown in FIG. 6.
Figure 12:
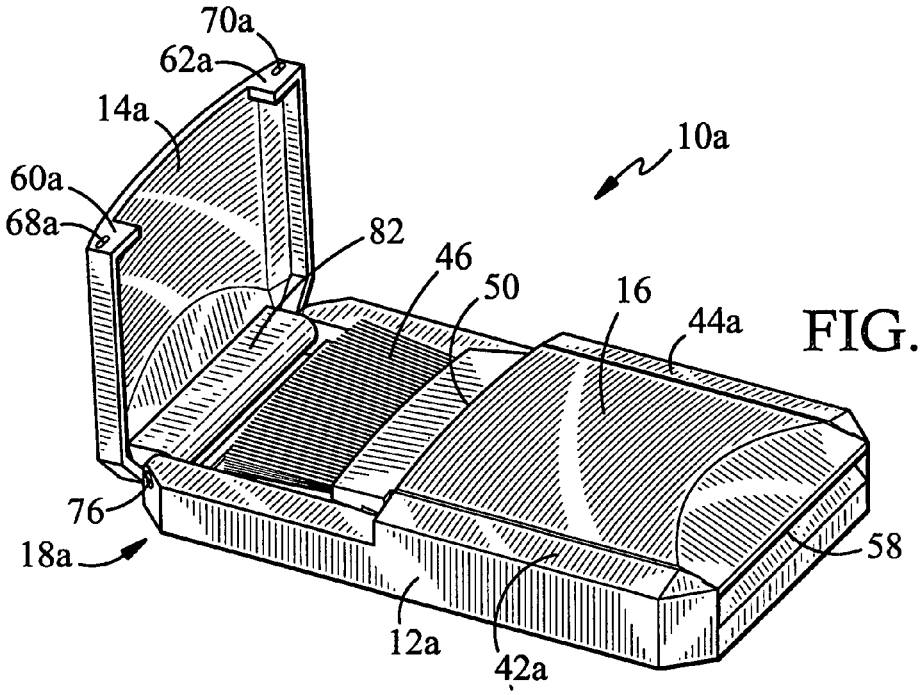
FIG. 12 is a view like FIG. 2 of a second embodiment of the invention, incorporating a pin-type hinge for the one cover.
Figure 13:
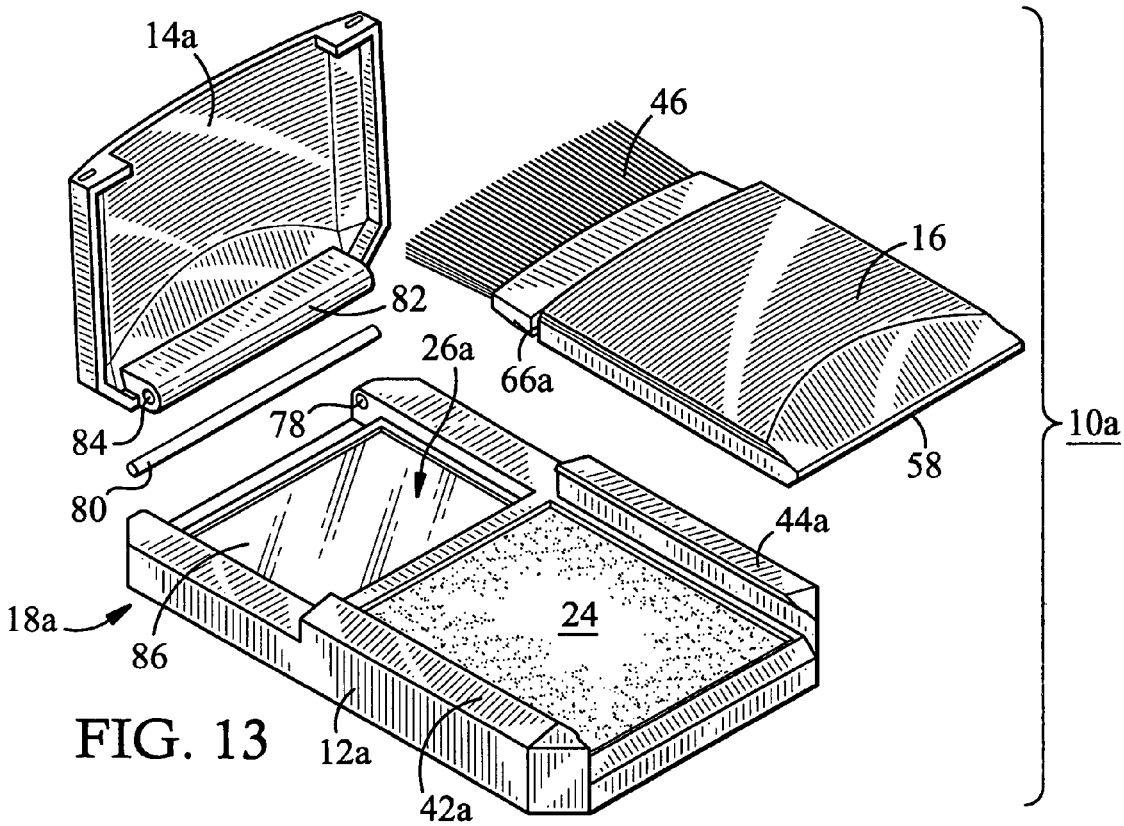
FIG. 13 is an exploded view of the compact of FIG. 12, showing the hinge barrel and the through-pin that secures the first cover to the base.
Figure 14:
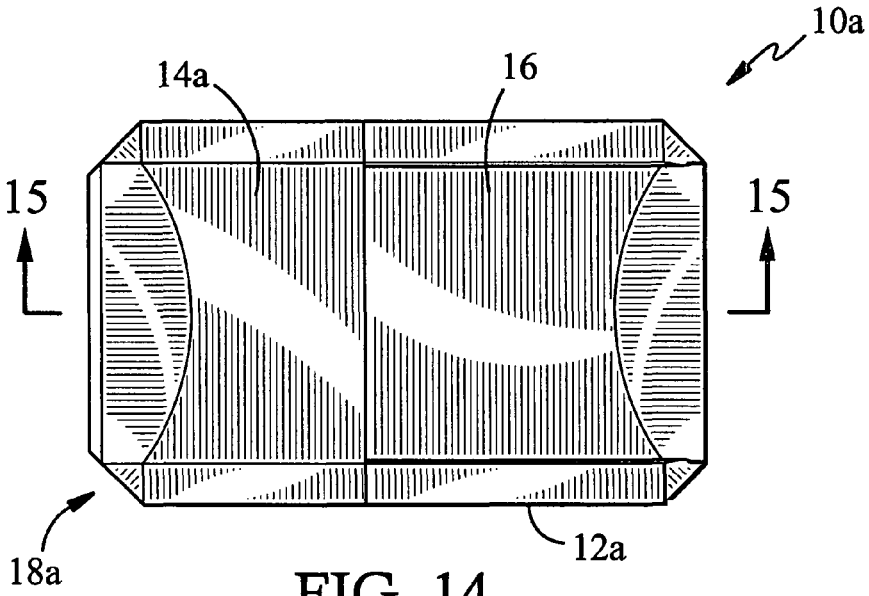
FIG. 14 is a top plan view of the compact of FIGS. 12 and 13.
Figure 15:
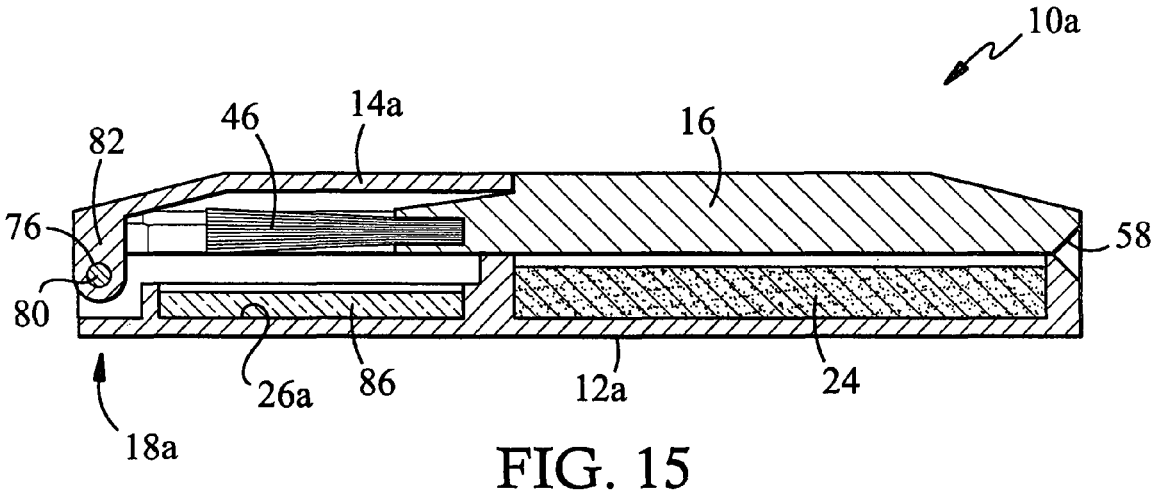
FIG. 15 is a section taken on the line 15-15 of FIG. 14.

As shown in FIGS. 3, 10 and 11, means are provided on the hinged cover 14 to selectively lock the combined second cover and grip handle 16 in its closed position on the base 12, and thus prevent it from sliding outwardly and away from the center of the base 12. In accomplishing this, the hinged cover 14 has at its edge, a pair of oppositely disposed flanges 60, 62, FIGS. 2-4, and the combined second cover and grip handle 16 has a pair of slots 64, 66, FIG. 3. When the removable combined second cover and grip handle 16 is in a closed position, FIGS. 1 and 5-9, the hinged cover 14 can be swung downwardly so that the flanges 60, 62 thereof are received in the slots 64, 66, respectively of the combined second cover and grip handle 16. In addition, there are nibs 68, 70, FIGS. 2 and 3, on the flanges 60, 62 respectively, which are receivable in corresponding recesses 72, 74, in the adjacent edge 50 of the combined second cover and grip handle 16, to hold the hinged cover 14 against freely swinging upwardly. Thus, by such an arrangement there is minimized the possibility of the compact inadvertently opening during storage or handling of the compact.

Further by the invention, either or both the cover or the combined second cover and grip handle can be transparent, and either or both the cover 14 and the combined second cover and grip handle 16 can have magnifying characteristics in their surfaces, to enable the user to better view the contents of the compact.

Another embodiment of the invention is shown in FIGS. 12-15, wherein corresponding reference numbers have been assigned to those of the first embodiment, and with a suffix "a" applied where the structure differs somewhat. In the disclosed arrangement the modified compact 10*a* has a base designated 12*a*. By the invention the cover 14*a* is swivelled on a pin-type hinge. The base's hinged or proximal end 18*a* has a pair of axially aligned holes 76, 78, FIGS. 12 and 13, for receiving a hinge pin 80. The cover 14*a* has a hinge barrel 82 with a through bore 84, FIG. 13, to receive the hinge pin 80. In addition, in the present arrangement, a mirror 86 is incorporated in a second compartment 26*a*, FIGS. 13, 15 of the modified base 12*a*.

The combined second cover and grip handle 16 is substantially the same as in the first embodiment. The locking arrangement between the covers 14*a*, and component 16 is similar to that of the first embodiment, specifically by means of the flanges 60*a*, 62*a* and the slots 66*a* (only one shown in FIG. 13) in the combined second cover and handle portion 16. The nibs are indicated by the numerals 68*a*, 70*a*, and are receivable in corresponding recesses (not shown in FIG. 12 or 13) in the combined second cover and grip handle 16.

In some applications, it may be desirable to utilize a pin-type hinge in place of the living hinge 13 of the first embodiment, since the pin-type hinge construction is rugged and reliable over extended periods of use.

Figure 16:
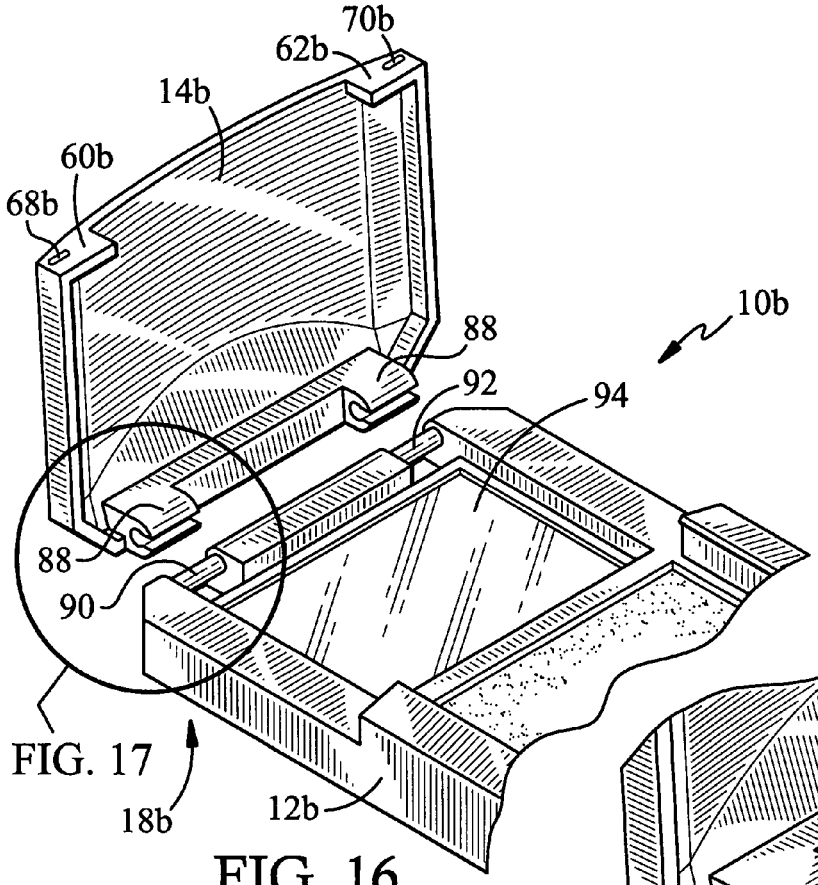
FIG. 16 is a fragmentary perspective view of a third embodiment of the invention, wherein a snap-type hinge is utilized in place of the pin-type hinge of the previous embodiment.
Figure 17:
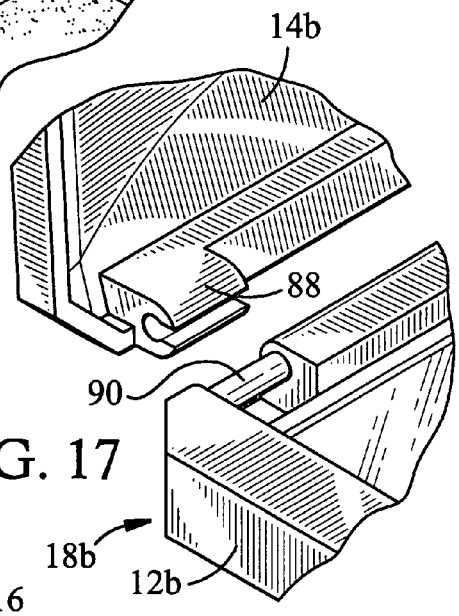
FIG. 17 is a detail of the snap-hinge structure of the compact of FIG. 16.
Figure 18:
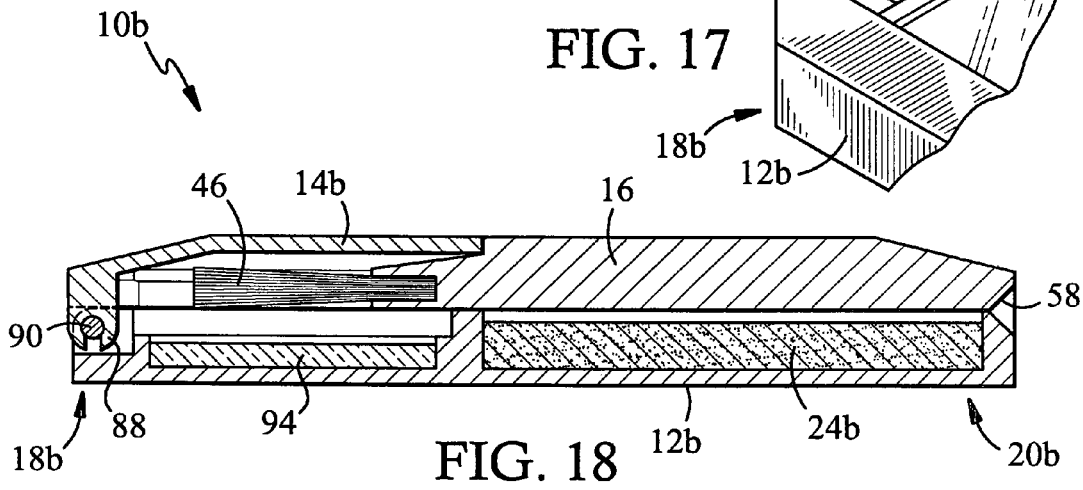
FIG. 18 is a longitudinal section through the compact of FIGS. 16 and 17.
Figure 19:
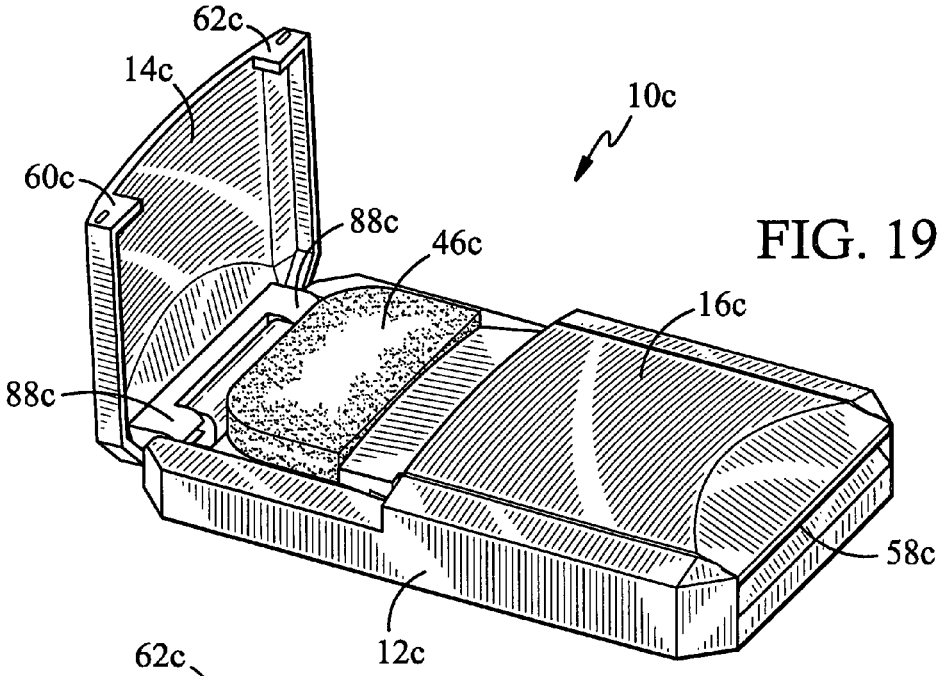
FIG. 19 is a perspective view of a fourth embodiment of the invention, showing a modified second cover having a modified, fabric type applicator in place of the brush of the first and second embodiments.
Figure 20:
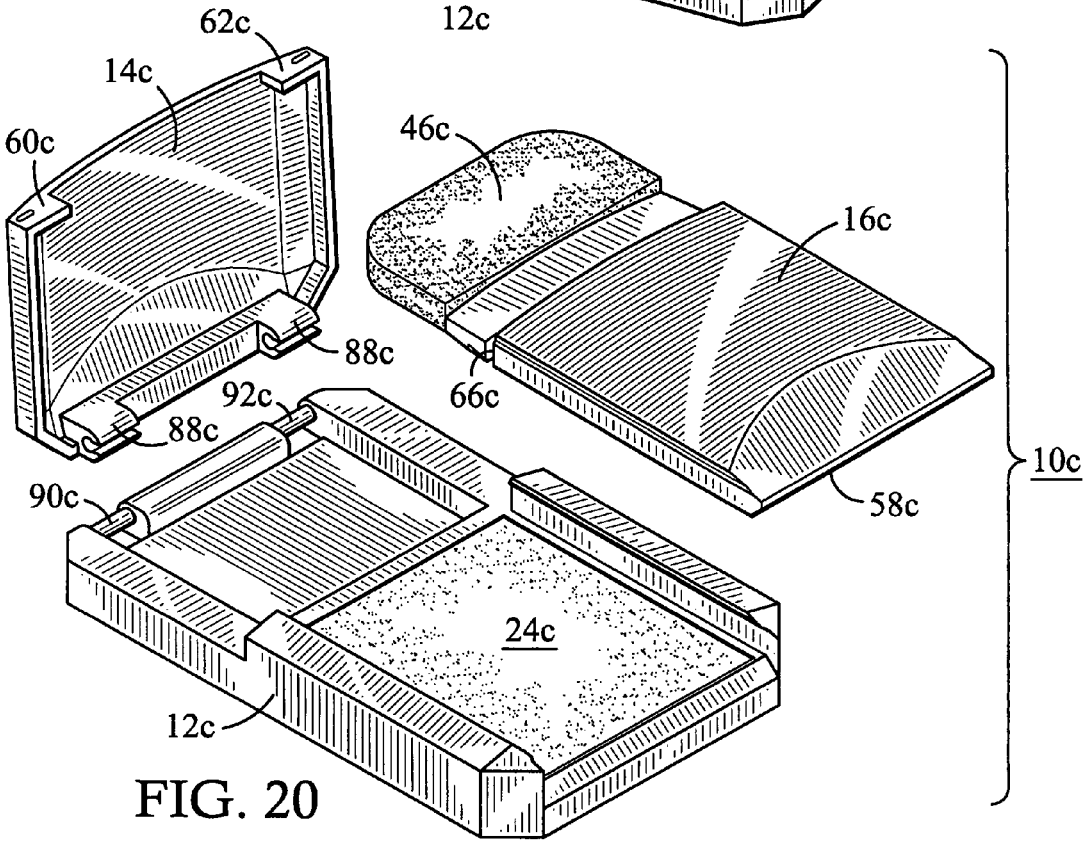
FIG. 20 is an exploded view of the compact of FIG. 19, illustrating the snap-hinge similar to FIGS. 16 and 17, and showing the modified applicator.
Figure 21A:
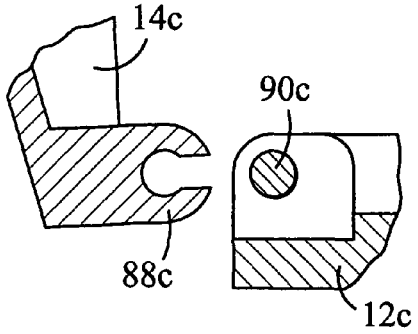
FIGS. 21*a*, 21*b*, and 21*c* are fragmentary sections of the snap-hinge structures of the compact of FIGS. 19 and 20.
Figure 21B:
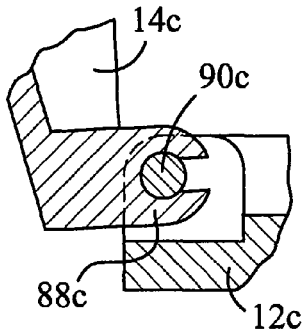
Figure 21C:
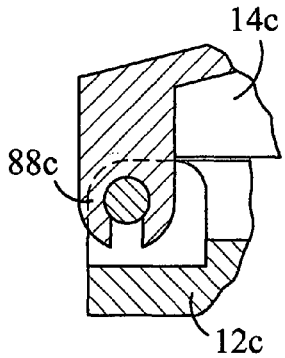

Still another embodiment, No. 3, of the invention is shown in FIGS. 16-18, wherein like reference numerals have been assigned to parts corresponding to the first embodiments, and with a suffix "b" added where there exists a somewhat similar but modified structure. The compact 10*b* has a base designated 12*b*, and the hinged cover is assigned 14*b*. There are provided on the base 12*b* and hinged cover 14*b* a modified hinge of a snap-type. The hinge details involve the cover 14*b* having a double-ended resilient barrel 88 which is slotted, and the base 12*b* having a double-ended pin structure 90, 92, which is arranged to receive the double-ended barrel 88.

FIGS. 16-18 show the construction. In this embodiment, there is provided a mirror 94 in the compartment that is adjacent to the hinged end of the base 12*b*. Also, the cover 14*b* can be completely removed from the base 12*b* if desired, as a consequence of the provision of slots in the barrel 88.

In other respects, the combined second cover and grip handle 16 and the product-holding/distributing portion or brush 46 are of a construction similar to that of the first embodiment.

Yet a fourth embodiment of the invention is illustrated in FIGS. 19-23. The compact 10*c* comprises a base 12*c*, a cover 14*c*, and a combined second cover and grip handle 16*c*. The cover 14*c* is connected to the base 12*c* by means of a snap-type hinge comprising barrel 88*c* and double ended pin 90*c*, 92*c*, as in the previous embodiment. FIGS. 21*a*-21*c* show the details of the hinge. A modified removable combined second cover and grip handle 16*c* is provided, in which the brush has been replaced by a fabric-based product-holding/distributing extension 46*c*. This fabric or fabric extension can be constituted of either natural or synthetic fibers, or of a flocked material, or of foam, latex or silicon, and it may be desirable to substitute one of these items for certain cosmetic applications.

Figure 22:
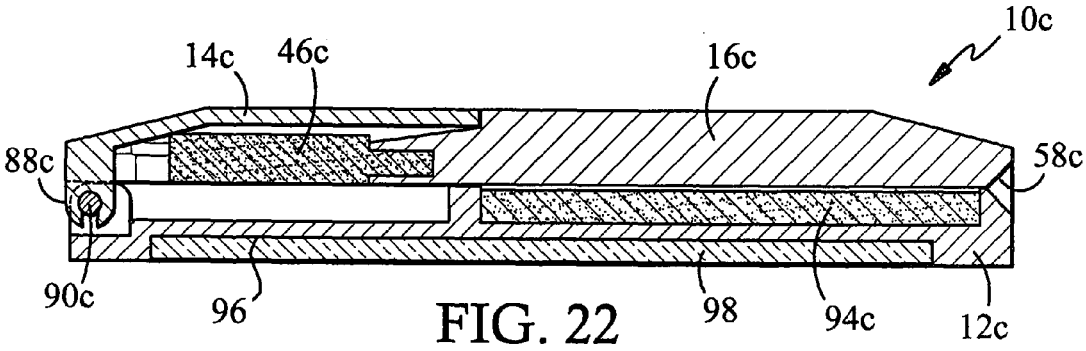
FIG. 22 is a longitudinal section of the compact of FIGS. 19 and 20, and illustrating in section, a mirror carried in a shallow recess at the bottom of the compact's base.
Figure 23:
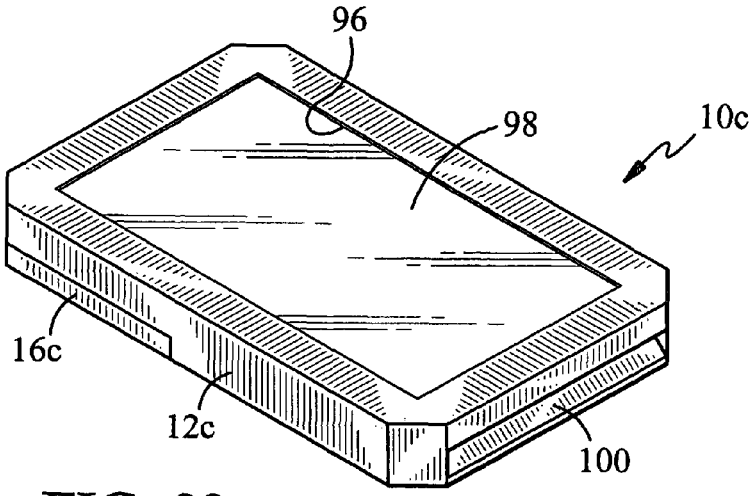
FIG. 23 is a bottom perspective view of the compact of FIGS. 19, 20 and 22, and illustrating the mirror carried thereby.

In accordance with the invention and as shown in FIGS. 22 and 23, the underside of the base 12*c* has an elongate, shallow recess 96 which extends substantially the full length of the base 12*c*. There is disposed in the recess 96 a mirror 98. The depth of the recess 96 is commensurate with the thickness of the mirror 98, such that a neat, flush appearance results. Providing a mirror 98 on the outside surface of the base 12*c*, as shown, assists the user in that it permits her to view her face and the distribution of her make up without opening either cover 14*c*, or removing the combined second cover and grip handle 16*c* of the compact. FIG. 23 shows the mirror 98, which is seen to cover a large extent of the base. A lifting edge 100 is also provided, to facilitate removal of the combined second cover and grip handle 16*c*.

Figure 24:
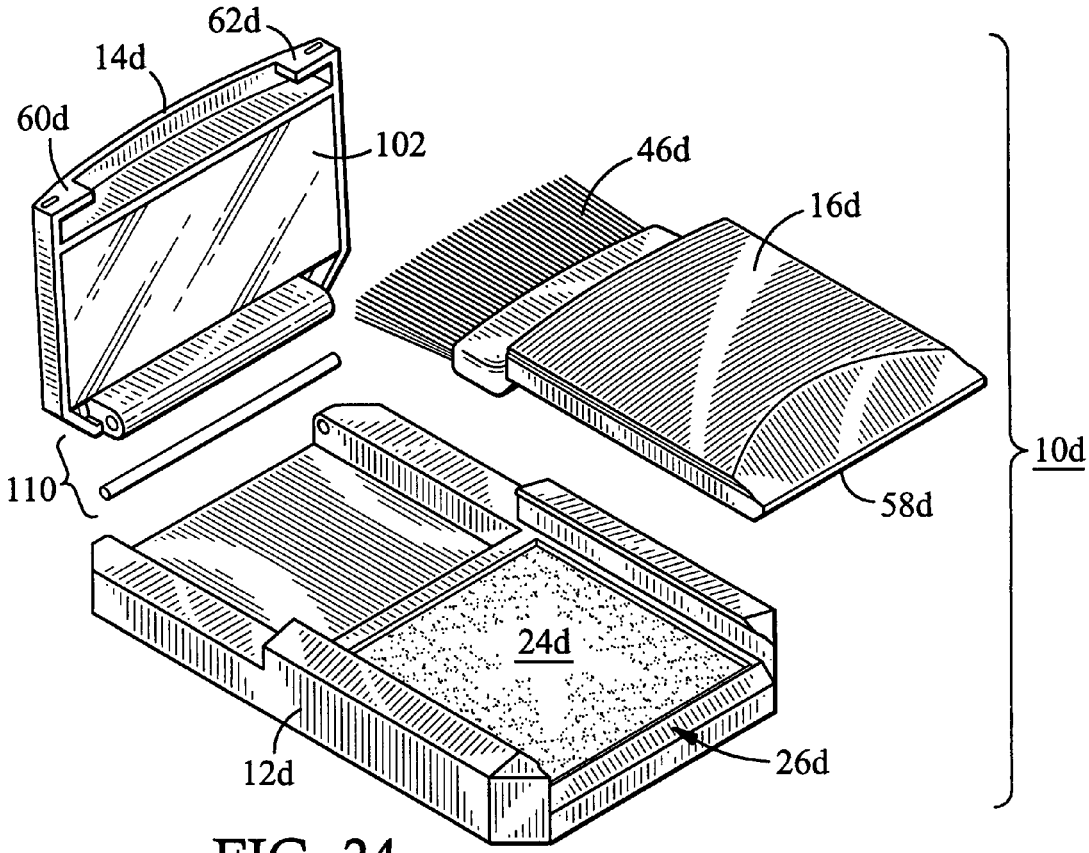
FIG. 24 is an exploded perspective view of a fifth embodiment of the invention, wherein a pin-type hinge is utilized with a mirror disposed on the underside of the first cover, and illustrating a second cover in the form of a combined second cover and grip handle, and wherein the applicator or brush lies in a plane that is laterally offset with respect to a plane in which the combined second cover and grip handle is disposed.
Figure 25:
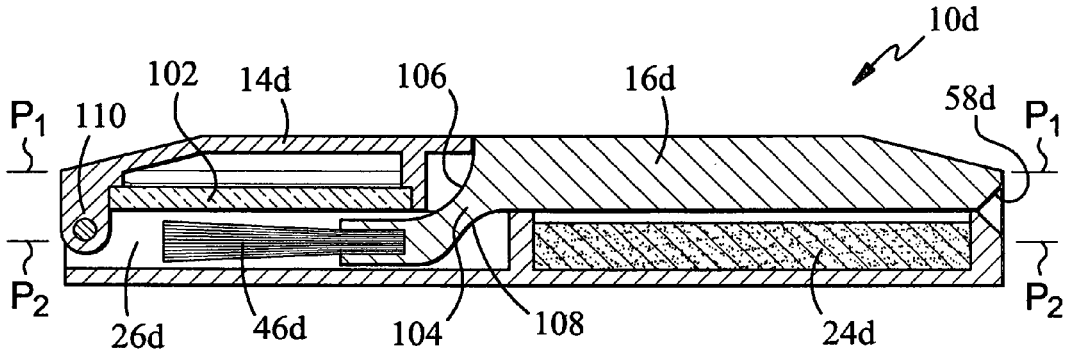
FIG. 25 is a longitudinal section of the compact of FIG. 24, showing the offset of the applicator with respect to the combined second cover and grip handle.
Figure 26:
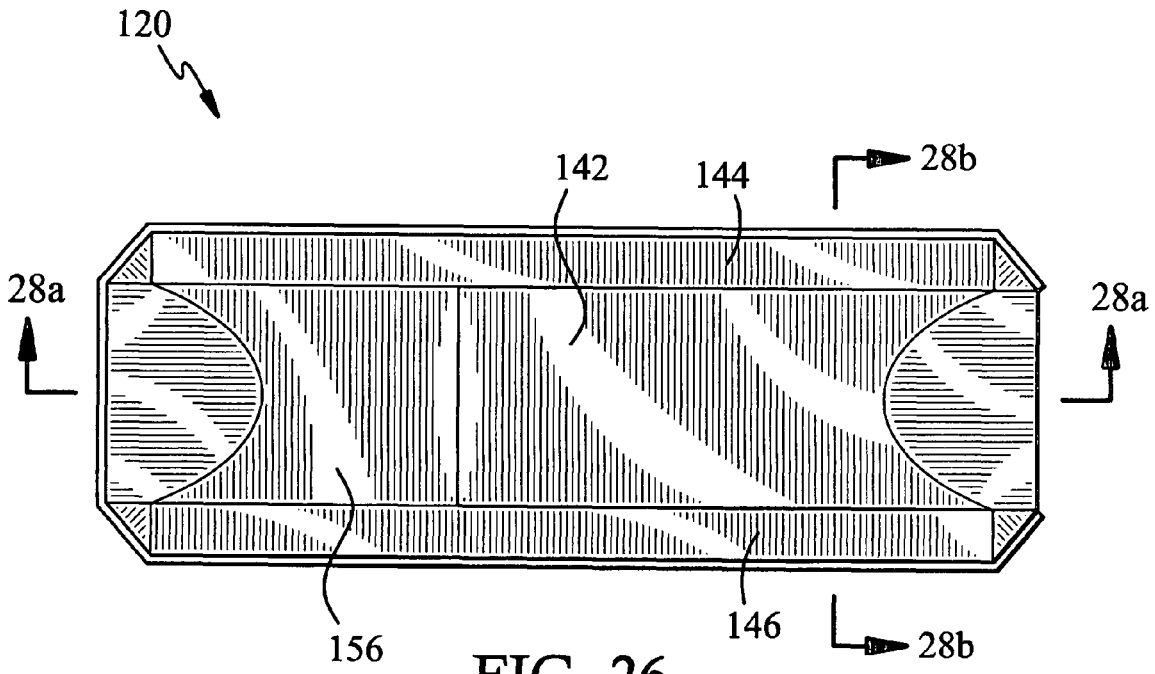
FIG. 26 is a top plan view of a sixth embodiment of the invention, showing a cosmetic compact having a single combined cover and grip handle means, which mount an applicator device on a base.

A fifth embodiment of the invention is illustrated in FIGS. 24 and 25. In the present instance, the compact 10*d* includes a hinged cover 14*d* provided with a mirror 102 on its underside, which becomes visible when the cover 14*d* is initially opened. The combined second cover and grip handle 16*d* overlies the cosmetic substance 24*d* contained in the compartment 26*d*, and also lies in a plane designated P1, and the product-holding distributing portion or fabric extension 46*d* (such as a fabric or mitt) is disposed in a second plane P2 which is offset laterally from the plane P1. With such an arrangement, the brush 46*d* can fit snugly in the compartment 26*d* of the base 12*d*, and the overall thickness of the compact can be reduced somewhat, as compared to the thicknesses of the devices of the prior embodiments. The juncture of the combined second cover and grip handle 16*d* and the brush 46*d* is in the form of a bent strip or bridge 104 of plastic having opposed surfaces 106, 108 which are generally concave in their configuration. Reference is made particularly to FIG. 25. As noted, the brush 46*d* thus fits beneath the hinged cover 14*d* and its contained mirror 102 when this cover 14*d* is closed.

In effect, the brush 46*d* is sandwiched between the hinged cover 14*d* and the base 12*d* when the hinged cover 14*d* is disposed in a closed position, as shown in FIG. 25. In operation, the compact of this embodiment is the same as that of the previously described embodiments.

Still another embodiment, No. 6, of the invention is shown in FIGS. 26-33. In accordance with the invention the improved compact is designated generally by the numeral 120. As in the previous embodiment the compact 120 is constituted of molded plastic, and includes an elongate base 122 which is constituted of two separate molded plastic pieces, 122*a* and 122*b*, FIG. 29, superposed one upon the other and fixed by means of a series of projections 124, FIG. 29 again, on the one piece 122*a* and cooperable abutment surfaces 126 or grooves 127 on the other 122*b* of the plastic pieces. Securement of the pieces can be by means of compatible adhesive, or alternately by means of sonic or ultrasonic welding. As in the previous embodiments, the base 122 has an upwardly facing compartment 128, FIGS. 29, 30, which contains a quantity of cosmetic substance or material 130 to be stored and used. The compartment 128 has a bottom wall 132, FIG. 28*b*, that is common with the base 122, and four side walls 134 136, 138 and 140, respectively connected therewith, FIGS. 28*a* and 28*b*, each side wall having an upper portion or lip.

Figure 30:
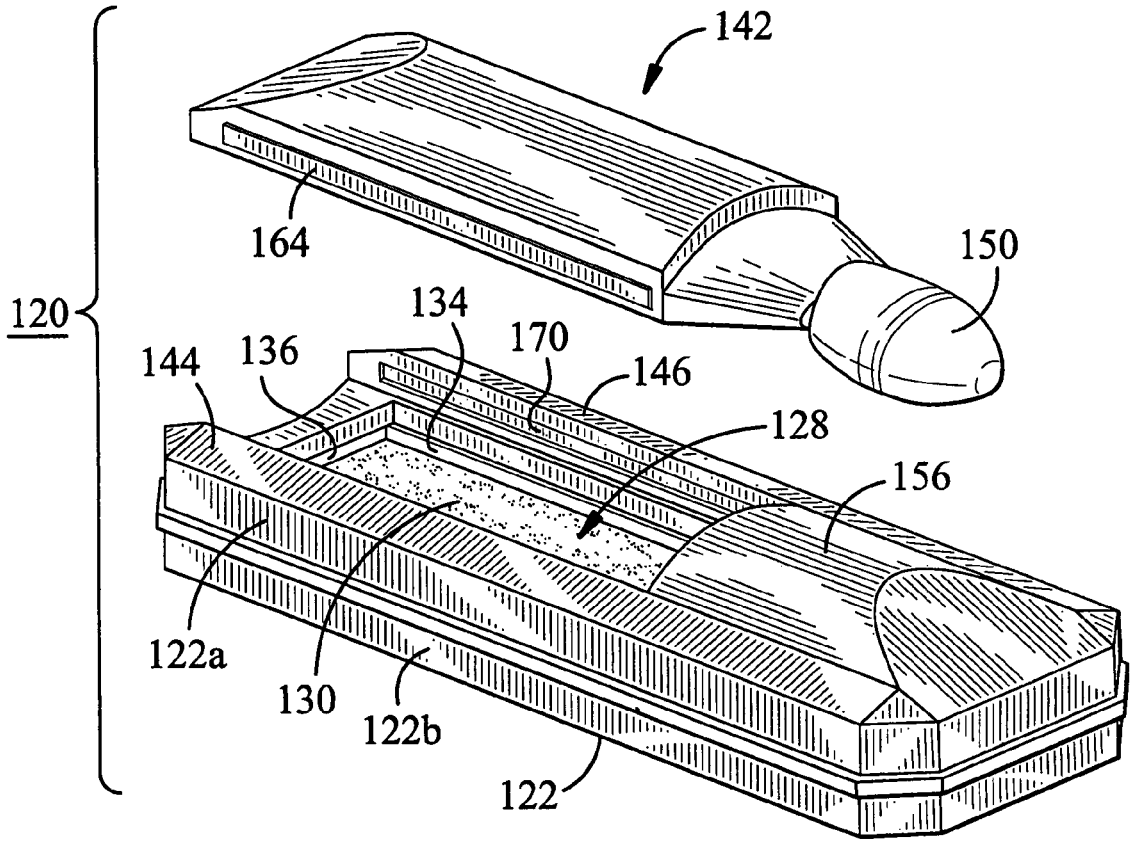
FIG. 30 is a perspective view of the compact of FIGS. 26-29, and illustrating the compact base and the combined cover and grip handle means disposed outside of and above the compact's base.
Figure 31:
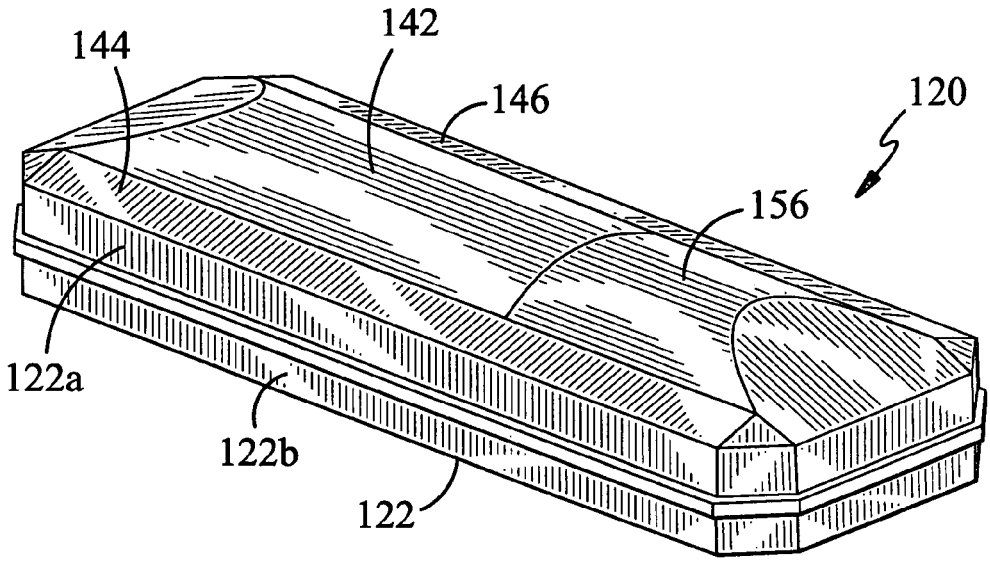
FIG. 31 is a perspective view of the compact of FIGS. 26-30, and illustrating the combined cover and grip handle means assembled to the base.

In contrast to the previous embodiments, the present compact has but a single combined cover and grip handle means 142 at one end, referred to as the distal end, this structure being completely removable from the base 122 as in FIG. 30, and being retained in position over the cosmetic substance-containing compartment 128 by means of oppositely disposed, resilient upstanding flanges 144, 146 on the base 122. The bottom wall surface 148, FIG. 28*a*, of the combined cover and grip handle means 142 is flat, which makes abutting contact with the upper part of the compartment walls 134, 136, 138 and 140, to thereby minimize any tendency for the cosmetic substance 130 to evaporate or otherwise dry out.

Figure 29:
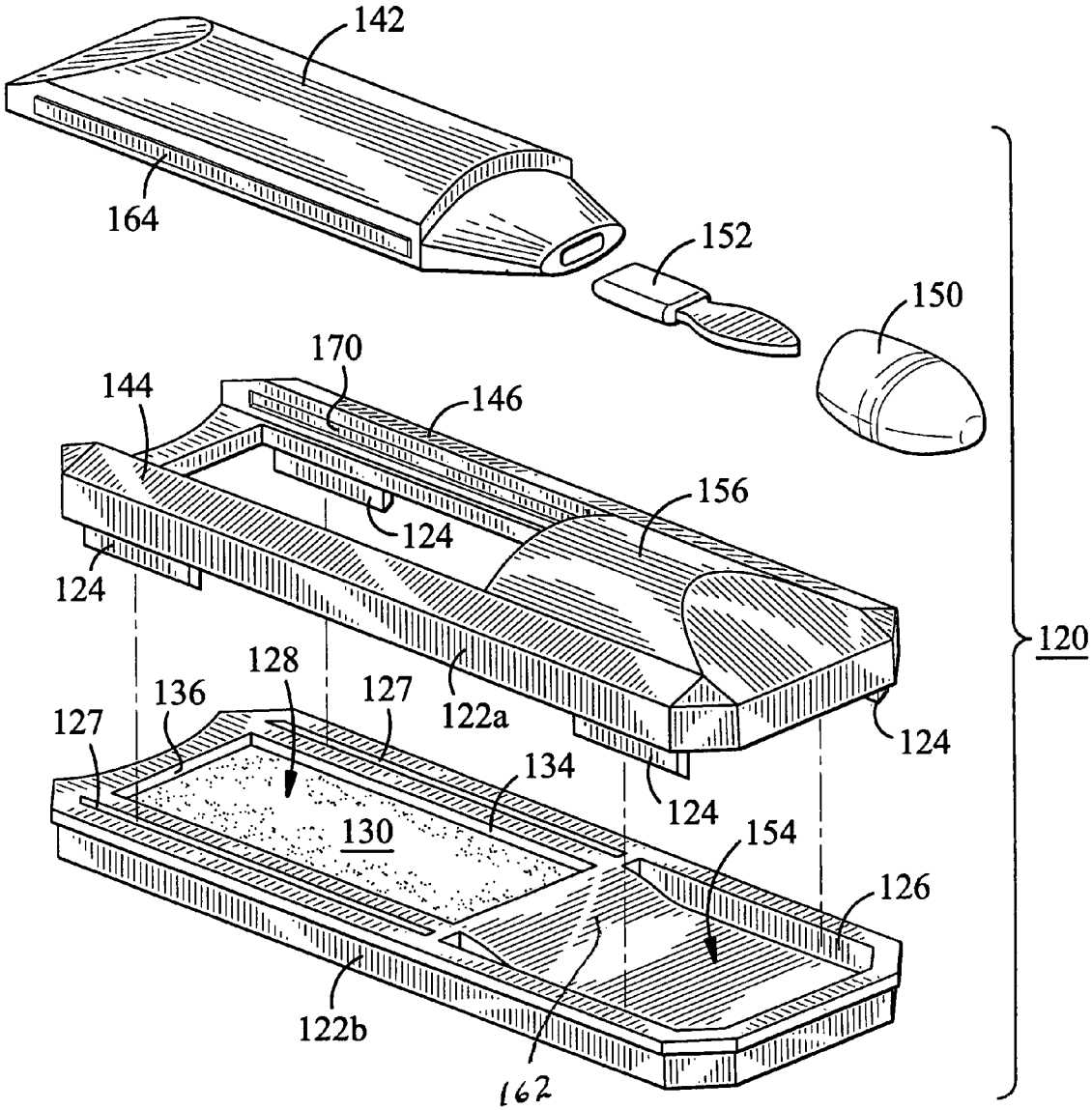
FIG. 29 is an exploded view of the components of the compact of FIGS. 26-28, illustrating interior details thereof.

By the invention, the combined cover and grip handle means 142 also mounts an applicator device 150, shown as being in the form of a bullet-shaped fabric tip. As illustrated in FIG. 29, this tip is removable from the remainder of the applicator device 150 to permit replacement or substitution, if this is ultimately desired. The applicator device 150 utilizes a separate adaptor fitting 152, FIG. 29, to secure it to the combined cover and grip handle means 142.

Further, there is provided a second compartment 154 defined between the base 122 and a fixed closure wall 156. The latter has a concave-downward surface 158, FIG. 28*a*, which effectively enlarges the size of the compartment 154 over what would prevail were the closure wall 156 flat, and in addition a convex-upwardly outer surface 160, FIG. 28*a*, which is arranged to be flush with the upper surface of the combined cover and grip handle means 142 as illustrated in this figure.

The arrangement is such that with the combined cover and grip handle means 142 occupying a closed position shown in FIGS. 26-28*a*, 28*b*, and 31-33, the applicator device 150 is disposed in the compartment or space 154 between the base 122 and closure wall 156. In order to facilitate withdrawal of the applicator device 150 from the compartment 154, there is provided a ramp or sloping slide surface 162, FIGS. 28*a*, 29, between the compartment 128 and the compartment 154. The ramp 162, in combination with the curvature of the closure wall 156, provides additional clearance for the applicator device. Thus, when the user initially withdraws the combined cover and grip handle means 142, the tip 152 can easily follow a slide path up the ramp 162 and thus exit the compartment 154 without encountering any sharp edges, or other types of mechanical interference.

The arrangement eliminates the likelihood of the tip 152 being inadvertently pulled off the combined cover and grip handle means 162 upon withdrawal of the same from the base 122.

Figure 28A:
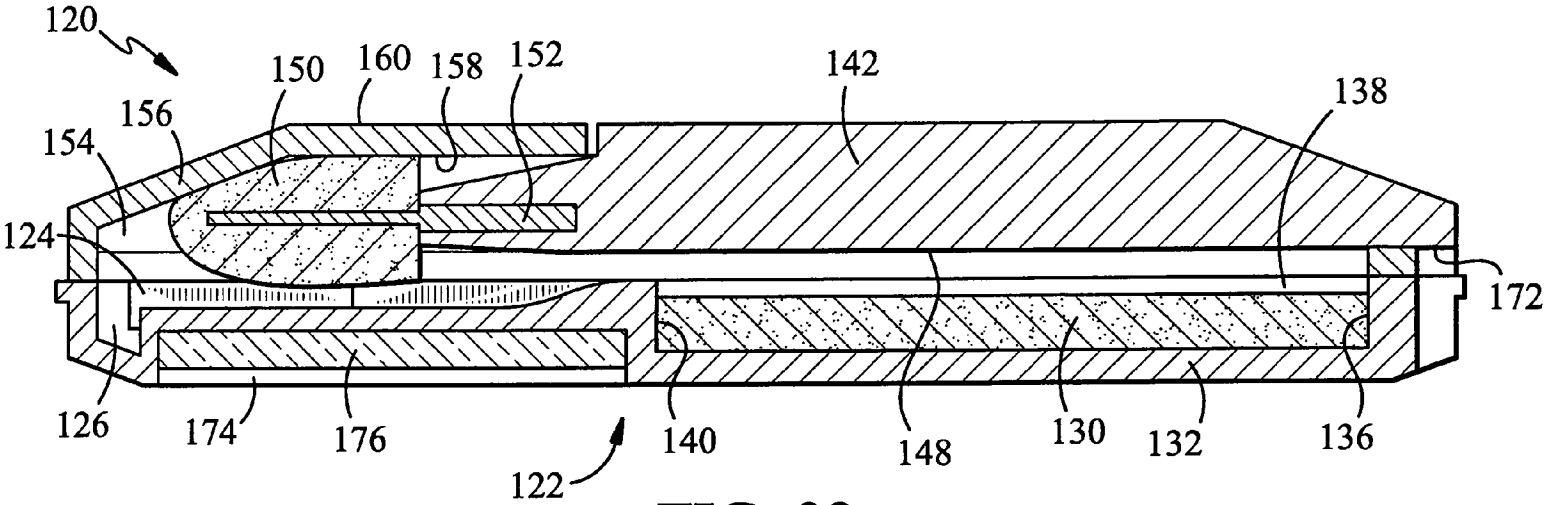
FIG. 28*a* is a longitudinal section taken on the line 28*a*-28*a* of FIG. 26.
Figure 28B:
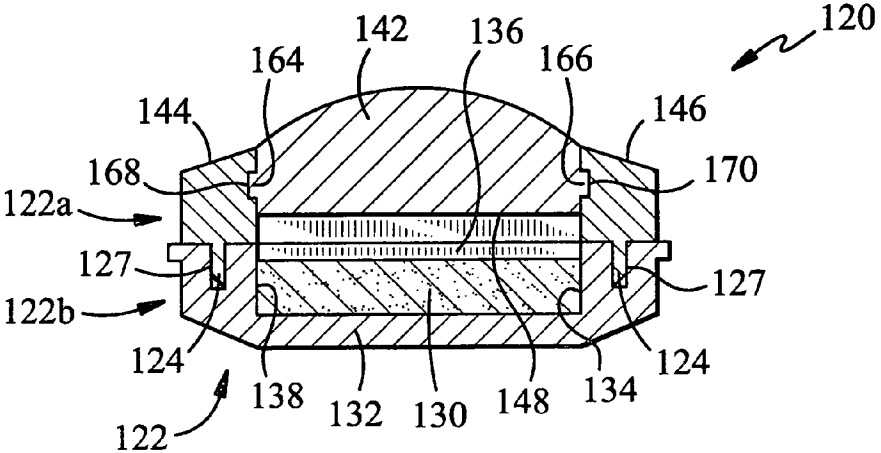
FIG. 28*b* is a transverse vertical section taken on the line 28*b*-28*b* of FIG. 26.

Also, in a preferred construction, the closure wall 156 and the combined cover and grip handle means 142 are sized to just overlie the base 122, FIG. 28*a*. This gives an exterior appearance similar to that of the first embodiment described above in connection with FIGS. 1-11. As a result, there is provided a physically small, neat package that can be readily carried in a purse or pocketbook.

Referring again to FIGS. 28*b* and 30, the combined cover and grip handle means 142 are releasably held between the flanges 144, 146, respectively, by suitable resilient retainer means, shown as being in the form of a pair of oppositely disposed, resilient longitudinal ribs 164, 166 on the sides of the combined cover and grip handle means 142, and corresponding grooves 168, 170 on the inner surfaces of the upstanding flanges 144, 146, respectively. The flanges 144, 146 are sufficiently resilient that the combined cover and grip handle means 142 can be pried upwardly wherein its ribs 164, 166 can deform sufficiently to permit them to slide out of the respective grooves 168, 170, respectively, in order to open the compact. The opening procedure is assisted by the provision of a lifting surface 172, FIG. 28, on the end of the combined cover and grip handle means 142, which provides a space for the user to insert her fingernail and pry the combined cover and grip handle means 142 upwardly.

Figure 27:
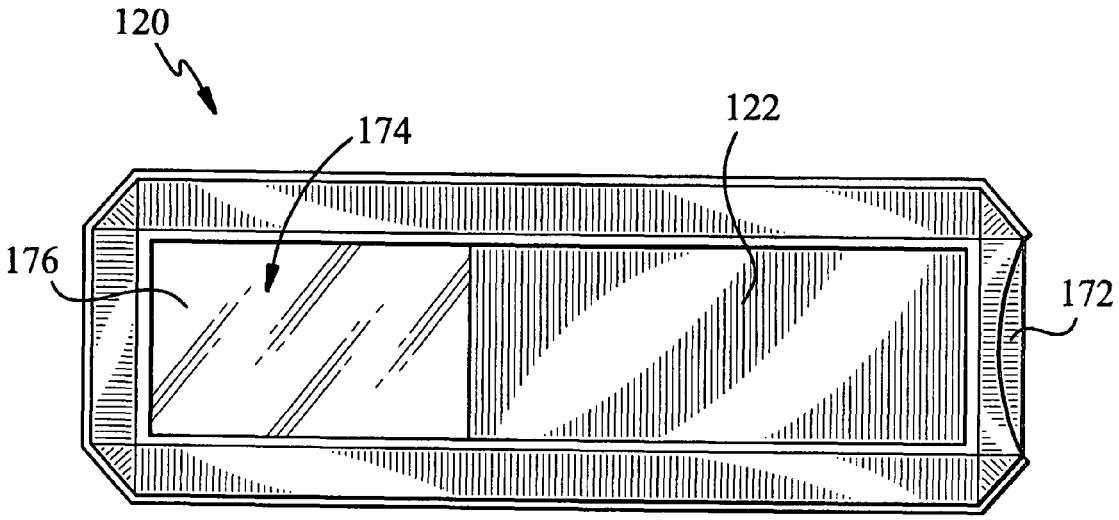
FIG. 27 is a bottom plan view of the compact of FIG. 26.
Figure 32:
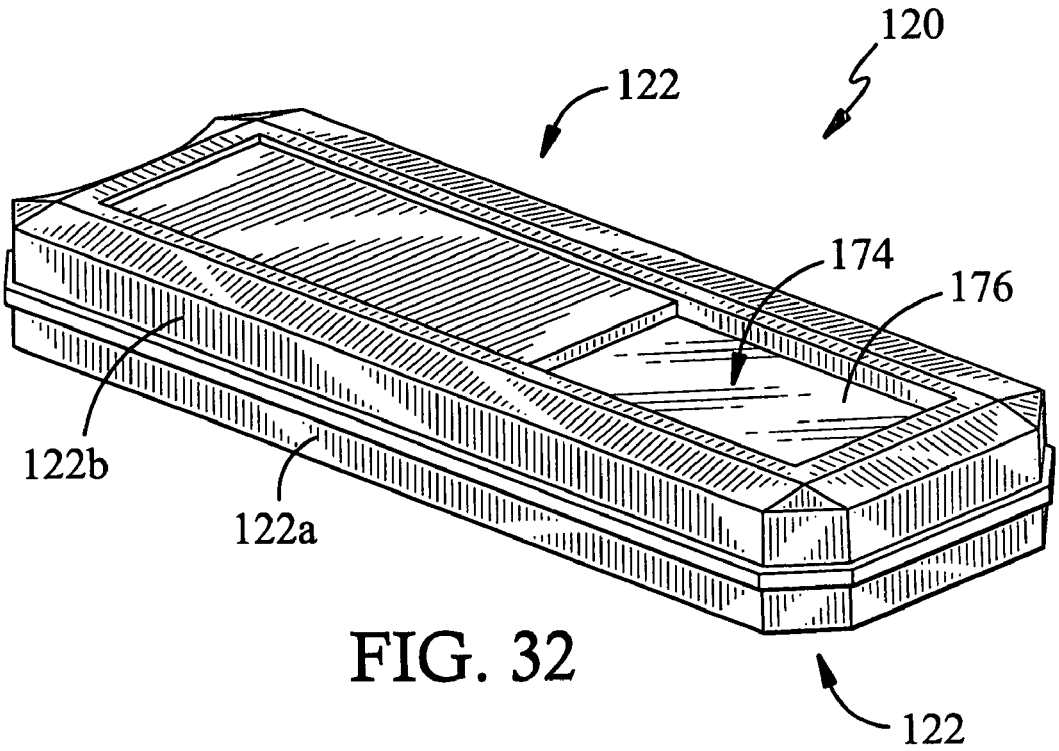
FIG. 32 is perspective view of the compact of FIGS. 26-31, showing a recess on the underside of the base, and a mirror fitted into said recess.
Figure 33:
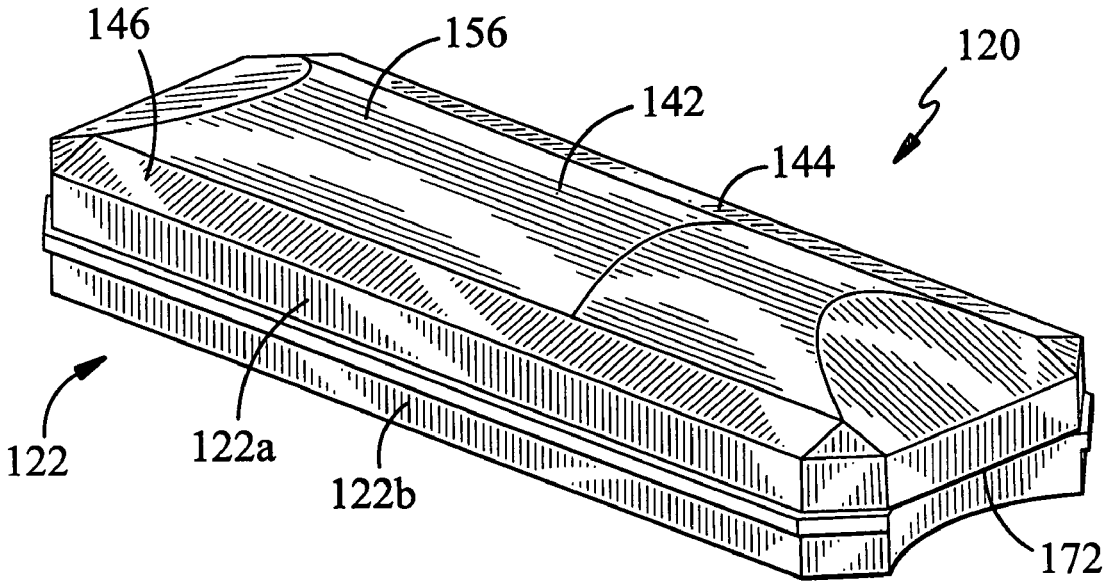
FIG. 33 is a perspective view like FIG. 31, taken from the opposite end of the compact with respect to that of FIG. 31.

Referring now to FIGS. 27, 28*a* and 32, the underside of the base 122, opposite to the compartments 128, 154, is provided with a shallow recess 174, and there is disposed in the recess a mirror 176 which is permanently affixed therein. The mirror's reflecting surface is arranged to direct reflected images outwardly from the base 122, as can be readily understood. No movement of the mirror, such as pivoting, occurs in the present construction. The mirror is thus available at all times, for the user to check her appearance without opening/removing the combined cover and grip handle means 142 of the compact.

From the above it can be seen that we have provided a series of novel and improved cosmetic compacts which are physically small, and yet which provide all the necessary features required of a full-service unit. In the first embodiment, by manufacturing the combined second cover and grip handle means of plastic as shown, there is achieved a double function by a single plastic component. First it closes over the free end of the cosmetic substance-containing compartment of the compact base so as to minimize inadvertent drying out of the cosmetic material. Second, it provides a gripping means for the user to hold, when transferring the cosmetic substance to the user's face. As a consequence, the amount of plastic that is required is reduced to a minimum.

Additionally, the compacts of the invention are seen to be especially eye-catching, and featuring an overall unusually attractive physical appearance when viewed from the outside.

The disclosed arrangements are thus seen to represent a distinct advance and improvement in the cosmetic field.

Each and every one of the appended claims defines an aspect of the invention which is separate and distinct from all others, and accordingly it is intended that each claim be treated as such in any determination of novelty or validity.

Variations and modifications are possible without departing from the spirit of the invention, and portions of the improvement can be used without others.

LIST OF REFERENCE NUMERALS

10, 10*a*, 10*b*, 10*c*, 10*d* Compact
12, 12*a*, 12*b*, 12*c*, 12*d* Base of compact
13 Living hinge
14, 14*a*, 14*b*, 14*c*, 14*d* Hinged cover
16, 16*c*, 16*d* Combined second cover and grip handle
18, 18*a*, 18*b* Hinge end or proximal end of base
20, 20*b* Free end of base
22 Upwardly facing compartment
24, 24*b*, 24*c*, 24*d* Cosmetic substance
26, 26*a*, 26*d* Second compartment
28 Mirror
30 Bottom wall of upwardly facing compartment
32 Compartment side wall
34 Compartment side wall
36 Compartment side wall
38 Compartment side wall
40 Bottom surface of the combined second cover and handle portion
42, 42*a* Upstanding flange or rail
44, 44*a* Upstanding flange or rail
46, 46*c*, 46*d* Product-holding/distributing portion, or brush
48 Edge portion of hinged cover
50 Edge portion of removable cover
52 Flush surface configuration
54 Longitudinal rib
56 Longitudinal rib
58, 58*b*, 58*c*, 58*d* Finger-engageable lifting surface
60, 60*a*, 60*b*, 60*c*, 60*d* Flange or rail
62, 62*a*, 62*b*, 62*c*, 62*d* Flange or rail
64 Slot
66, 66*a*, 66*c* Slot
68, 68*a*, 68*b* Nibs
70, 70*a*, 70*b* Nibs
72 Recess
74 Recess
76 One of a pair of aligned holes
78 The other of the pair of aligned holes
80 Hinge pin
82 Barrel part
84 Through bore
86 Mirror
88, 88*c* Barrel of hinge
90, 92, 90*c*, 92*c* Double ended pin formation
94 Mirror
96 Recess
98 Mirror
100 Finger-engageable lifting edge
102 Mirror
104 Connecting Bridge
106 Concave surface of bridge
108 Concave surface of bridge
110 Hinge
L1 length #1
L2 length #2
L3 length #3
P1 plane #1
P2 plane #2
120 Compact
122 Base
122*a* Part of base
122*b* Part of base
124 Projections
126 Abutment surfaces
127 Grooves
128 Compartment
130 Cosmetic substance or material
132 Bottom wall
134 Side wall
136 Side wall
138 Side wall
140 Side wall
142 Combined cover and grip handle means
144 Flanges or rails
146 Flanges or rails

148 Bottom wall surface of combined cover and grip handle means
150 Applicator device
152 Adapter fitting
154 Second compartment
156 Closure wall
158 Concave surface of closure wall
160 Convex surface of closure wall
162 Ramp
164 Longitudinal rib
166 Longitudinal rib
168 Groove
170 Groove
172 Finger-engageable lifting surface
174 Recess
176 Mirror

What is claimed is:

1. A cosmetic compact, comprising in combination:

a) a molded plastic base having an upwardly facing compartment for storing a quantity of cosmetic product, said base having a hinged end and having a free end disposed opposite to the hinged end, said compartment being disposed adjacent the free end of the base, b) a first cover, c) hinge means connecting the first cover to the hinged end of the base, to enable the first cover to be manually swung between a closed position overlying the hinged end of the base and an open position exposing the hinged end of the base, d) a combined second cover and grip handle, and cooperable means on said second cover and grip handle and on said base for releasably securing the second cover and grip handle to the base, e) said second cover and grip handle, when secured to the base, overlying said compartment and forming an abutting-type fit therewith so as to minimize inadvertent drying out of the cosmetic product stored therein, and f) an applicator device carried by said combined second cover and grip handle, the latter enabling the user to hold and to manipulate the applicator device, g) said second cover and grip handle positioning the applicator device at a location which is disposed between said first cover and the hinged end of the base at such times as the first cover is in its closed position and the combined second cover and grip handle is secured to the base, h) said base having upstanding flanges disposed on its lateral sides and wherein said combined second cover and grip handle fit snugly between said upstanding flanges and are held in position thereon, i) said flanges being sufficiently resilient to enable them to yield outwardly and receive the combined second cover and grip handle when the latter is placed onto the base.

2. The invention as set forth in claim 1, wherein:

a) said flanges yield outwardly when the combined second cover and grip handle is physically pried upwardly, with respect to the underlying base.

3. A cosmetic compact, comprising in combination:

a) a molded plastic base having a generally rectangular configuration, and further having a hinged end and a free end, said free end having an upwardly facing rectangular compartment adapted for storing a quantity of cosmetic product, said base having a second compartment disposed adjacent the hinged end and being generally aligned with said upwardly facing compartment, b) a first cover, c) hinge means pivotally connecting the first cover to the hinged end of the base, to enable the first cover to be manually swung between a closed position overlying the second compartment and an open position exposing the said second compartment, d) a combined second cover and grip handle, and a pair of substantially parallel upstanding flanges disposed on lateral sides of said first-mentioned compartment, for releasably securing the combined second cover and grip handle in a position overlying the first-mentioned compartment and forming an abutting-type fit therewith so as to minimize inadvertent drying out of the cosmetic product stored therein, and e) an applicator device carried by said combined second cover and grip handle, the latter enabling the user to hold and to manipulate the applicator device when removed from the base, f) said combined second cover and grip handle positioning the applicator device at a location which is disposed between said first-mentioned cover and second compartment at such times as the combined second cover and grip handle is secured to the base, g) said first cover and said combined second cover and grip handle have edge portions which abut one another when the first cover is disposed in its closed position, and the combined second cover and grip handle are secured over said first-mentioned compartment, h) said edge portions forming substantially smooth surface continuations of one another such that the abutting edge portions are aligned and substantially completely flush with one another.

4. A cosmetic compact, comprising in combination:

a) a molded plastic base, b) a first cover, c) hinge means connecting the first cover to the base, to enable it to be manually swung between a closed position overlying part of the base and an open position exposing the base, d) a combined second cover and grip handle completely separate from the first cover, said combined second cover and grip handle being slidable between a closed position toward the center of the base, and an open position in a direction either away from the center of the base or else completely removed from physical contact with the base, and e) cooperable means for locking said combined second cover and grip handle against inadvertent sliding movement away from the center of the base only when the first cover is disposed in its closed position, and for releasing said combined second cover and grip handle to permit sliding movement thereof away from the center of the base and subsequent full disconnect from the base when the first cover is shifted from its closed position toward its open position, f) said cooperable locking means comprises a flange on the first cover, and g) means defining a recess in the combined second cover and grip handle and arranged to receive said flange when the combined second cover and grip handle is in a closed position overlying the base and the first cover is swung to its closed position overlying part of the base.

* * * * *